United States Patent [19]

Bandoh et al.

[11] Patent Number: 4,543,684

[45] Date of Patent: Oct. 1, 1985

[54] APPARATUS FOR CLEANING PLASTICS FORMING MOLD FACES

[76] Inventors: Kazuo Bandoh, No. 81-8, Tōyama, Momoyama-chōFushimi-ku, Kyōto-shi; Michio Osada, No. 6-197, 3-chōme, Myōjyo-chōUji-shi, Kyōto-fu, both of, Japan

[21] Appl. No.: 543,137

[22] Filed: Oct. 18, 1983

[30] Foreign Application Priority Data

Oct. 25, 1982 [JP] Japan ..... 57-187830

[51] Int. Cl.[4] ..... A47L 5/02

[52] U.S. Cl. ..... 15/309; 15/312 R; 15/345; 15/379; 15/382; 164/158

[58] Field of Search ..... 15/309, 312 R, 345, 15/379, 382; 164/158

[56] References Cited

U.S. PATENT DOCUMENTS

| | | | |
|---|---|---|---|
| 955,467 | 4/1910 | Moorhead | 15/345 X |
| 2,744,286 | 5/1956 | Carpenter et al. | 15/345 X |
| 2,974,379 | 3/1961 | Mills | 164/158 |
| 3,161,900 | 12/1964 | Hornschuch et al. | 15/345 |
| 3,248,762 | 5/1966 | Wagner | 164/158 |
| 3,813,726 | 6/1974 | Kowalewski | 15/379 X |
| 4,461,051 | 7/1984 | Schindel | 15/104.1 R X |

FOREIGN PATENT DOCUMENTS

| | | | |
|---|---|---|---|
| 88268 | 1/1967 | France | 13/379 |
| 454026 | 2/1975 | U.S.S.R. | 15/382 |
| 858760 | 8/1981 | U.S.S.R. | 15/345 |

OTHER PUBLICATIONS

IBM Technical Disclosure Bulletin; vol. 19, No. 3, Aug. 1976; K. J. Puttlitz, K. Schink and H. Wenskus.

*Primary Examiner*—Philip R. Coe
*Assistant Examiner*—Frankie L. Stinson
*Attorney, Agent, or Firm*—Larson and Taylor

[57] ABSTRACT

An apparatus for cleaning plastics forming mold faces comprising composite brushes each consisting of a vibratory brush adapted to be vibrated in a vertical direction or in unspecified directions by a vibrating mechanism, and a rotary brush annularly surrounding the vibratory brush and adapted to be rotated in a horizontal direction, the composite brushes being disposed in opposed relation to the faces of two mold halves, a dirt sucking mechanism having a vacuum source for sucking and removing flash peeled from the mold faces by the vibratory and rotary brushes, and an air blowing mechanism for blowing air against the mold faces to cool the flash so as to enhance the flash peeling action of the vibratory and rotary brushes.

7 Claims, 7 Drawing Figures

FIG. 5A
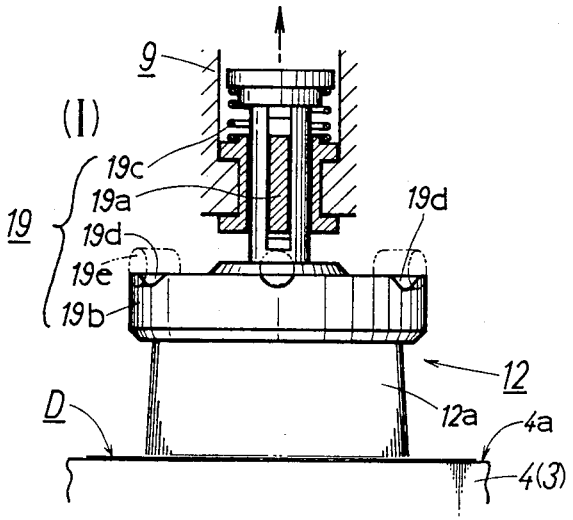
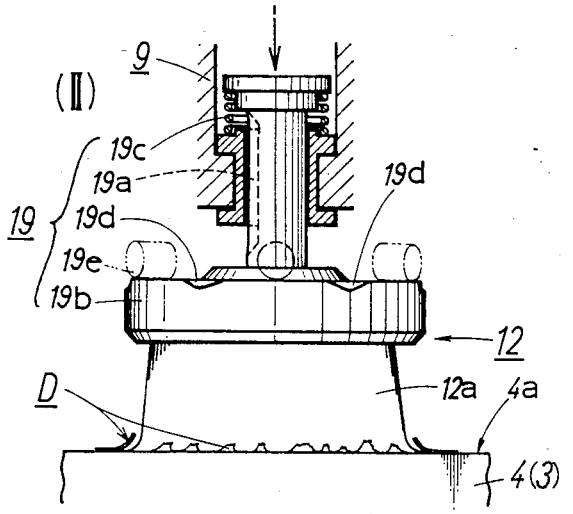
FIG. 5B

APPARATUS FOR CLEANING PLASTICS FORMING MOLD FACES

BACKGROUND OF THE INVENTION

In plastics molding, most of the flash that has flowed out to the mating faces of the fixed and movable mold halves and adhered thereto is taken out together with the molded articles when the latter is taken out, but even a trace of residual flash adhering to the mold faces interferes with complete closure of the molds for the next molding operation bringing about various troubles, particularly the formation of defective moldings, so that it is necessary to clean the mold faces by removing flash upon completion of each molding operation.

Particularly where the plastic material is an epoxy type thermosetting plastic material whose adhesion to the mold faces is strong, removal of flash by manual operation is very difficult, and moreover, if mold closure is effected with even a very small amount of flash adhering thereto, the result is the creation of a very high local surface pressure which would damage the mating faces of the molds.

To avoid the danger and inefficiency of manual flash removal operations, there has been developed a cleansing means which comprises blowing air against the mold faces, peeling flash adhering to the mold faces by a rotary brush, and sucking away said flash.

With this cleaning means using a rotary brush as a flash peeling member, however, the flash peeling action of said brush is only to the extent of simply rubbing the flash with its bristles, so that even if a cooling means using an air blow is used in combination with the rubbing means using the rotary brush, effective peeling of flash cannot be expected, and a considerably long period of time is still required for complete peeling of flash. Thus, the cleaning means contributes little to increasing the production of the plastic moldings.

To solve the aforesaid problem, there has previously been invented an apparatus for cleaning mold faces which comprises brush members disposed in opposed relation to the plastics forming mold faces, suitable vibrating means for vibrating said brush members so that the front ends of said brush members beat, break, and peel the flash that has remained adhered to the mold faces, and suction a means for sucking the peeled flash away from the mold faces to remove the flash. However, it has been found that even with this apparatus, satisfactory removal of flash is impossible.

SUMMARY OF THE INVENTION

The present invention relates to an apparatus for cleaning plastics forming mold faces and more particularly it relates to improvements in a cleaning apparatus for removing the flash that has remained adhered to the plastics forming mold faces.

A principal object of the present invention is to provide an apparatus for cleaning plastic forming mold faces which is capable of efficiently and reliably peeling flash remaining adhered to the mold faces in a short time.

Another object of the invention is to provide an apparatus for cleaning plastics forming mold faces wherein a rotary brush and a vibratory brush are used in combination as flash peeling means, whereby the peeling of flash can be effected particularly efficiently and reliably as compared with the case of separately using these brushes.

A further object of the invention is to provide an apparatus for cleaning plastics forming mold faces wherein flash on the mold faces is sucked away to the outside of the molding machine while cooling said flash, whereby the flash peeling and removing effect can be further increased.

An apparatus for cleaning plastics forming mold faces according to the present invention is characterized in that the apparatus comprises vibratory brushes adapted to be vibrated by vibrating mechanisms and disposed in opposed relation to the faces of two mold halves, rotary brushes adapted to be rotated in a horizontal direction by rotating mechanisms and disposed in opposed relation to the mold faces and surrounding said vibratory brushes, and a dirt sucking mechanism for sucking away flash peeled from the mold faces by said two types of brushes, and in that an air blowing mechanism is added which blows air against the faces of the two mold halves.

According to the cleaning apparatus of the invention constructed in the manner described above, since vibratory and rotary brushes are used in combination as a means for peeling flash from mold faces, flash beaten and broken by the front ends of the vibratory brushes can be efficiently peeled by the rotary brushes, so that the mold faces can be efficiently cleaned in a short time.

Further since the rotary brushes surround the respective vibratory brushes, the rotary brushes act to guide the flashed peeled by the vibratory and rotary brushes to an air suction path, thus enhancing the flash removing effect.

Further, the provision of the air blowing mechanism for blowing air against the faces of the two mold halves, besides the dirt sucking mechanism for sucking flash, makes it possible to enhance the action of peeling flash from the mold faces, thus further heightening the aforesaid effect.

BRIEF DESCRIPTION OF THE DRAWINGS

The drawings show preferred embodiments of the invention.

FIG. 5A is a detail of FIG. 4 with the brush member moved away from the corresponding mold face; FIG. 5B is a detail of FIG. 4 with the brush member moved towards the corresponding mold face.

Figure 2:
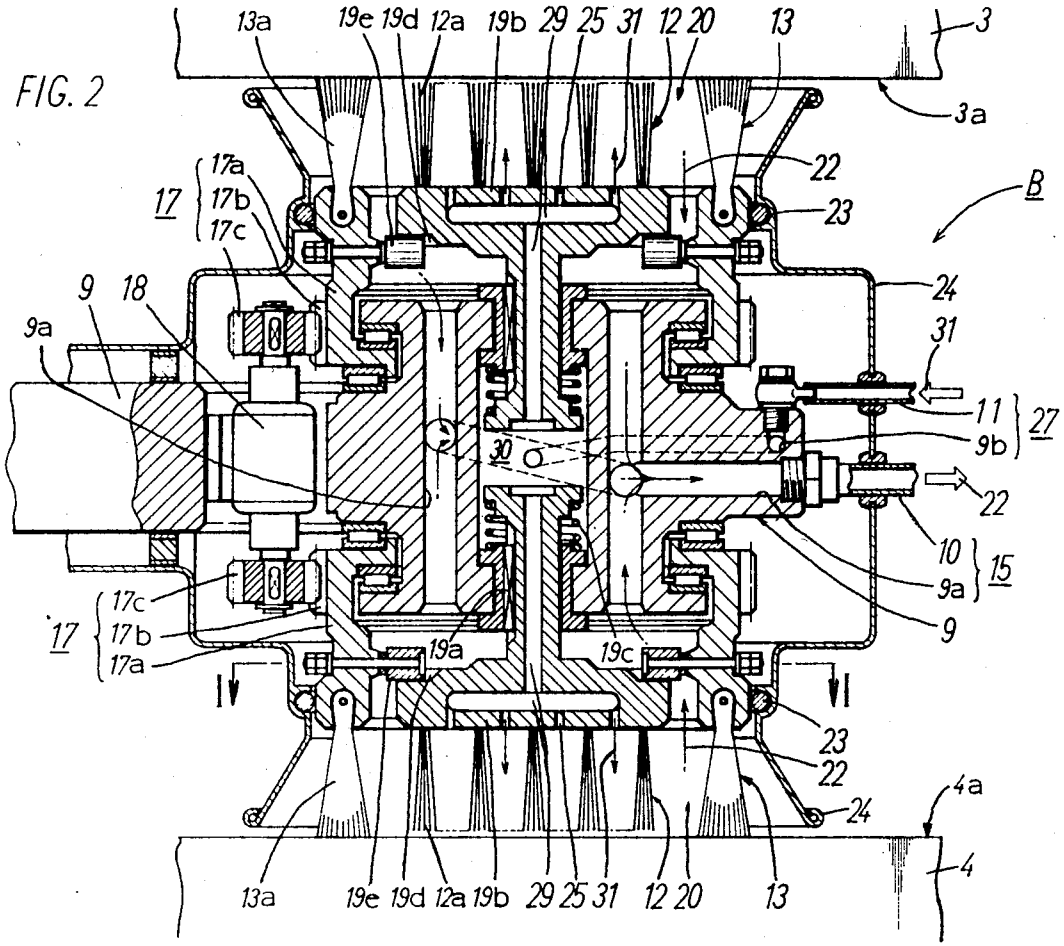
FIG. 2 is an enlarged fragmentary longitudinal section of the principal portion of the apparatus of the invention.
Figure 3:
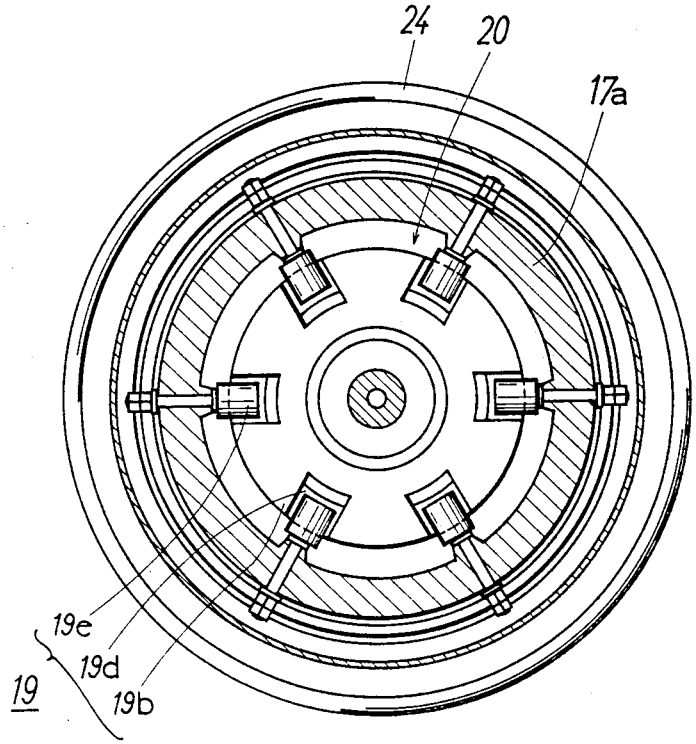
FIG. 3 is a section taken along the line I—I in FIG. 2.
Figure 6:
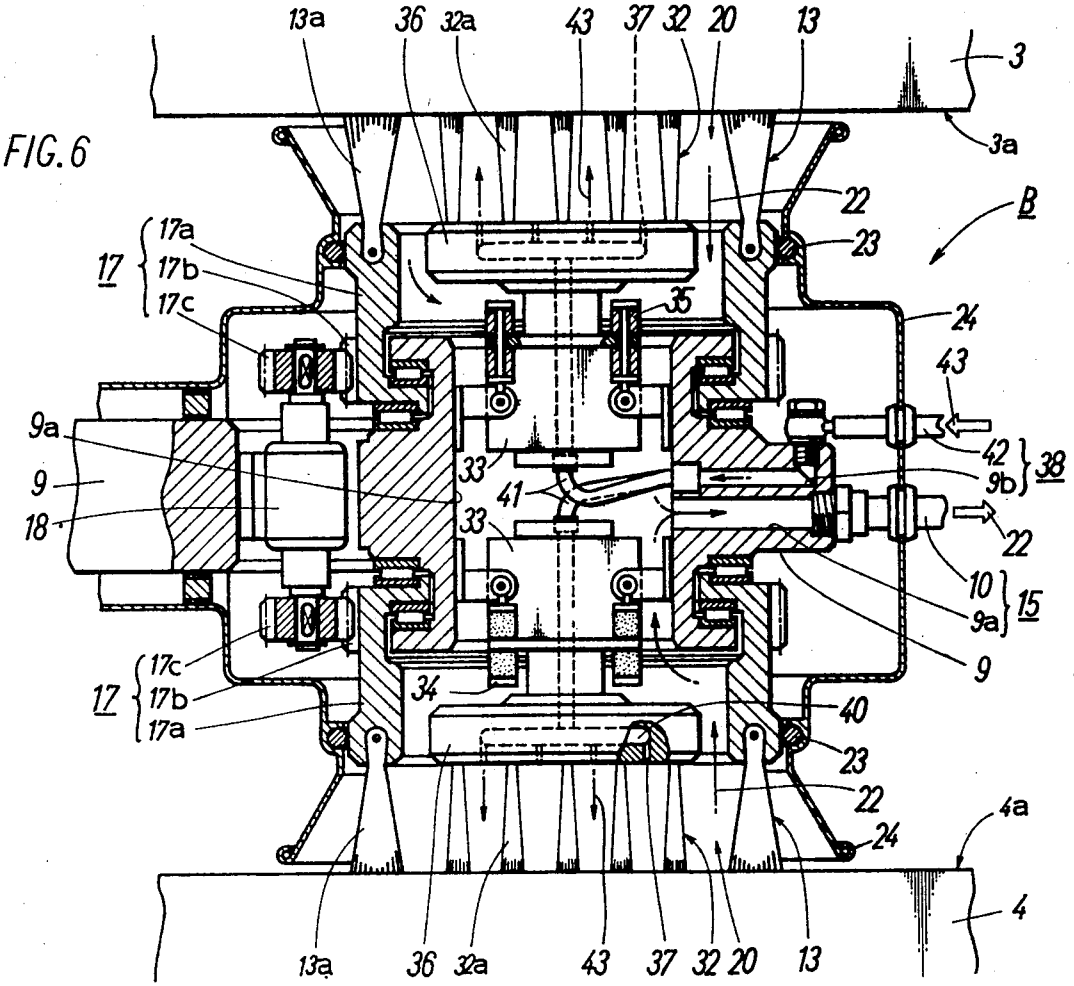
FIG. 6 is a fragmentary vertical section of an apparatus of the invention having vibratory brushes which vibrate in unspecified directions.

In addition, in FIGS. 2, 3, and 6, air hose connections are shown displaced through approximately 90 degrees.

DETAILED DESCRIPTION OF THE PREFERRED EMBODIMENTS

Figure 1:
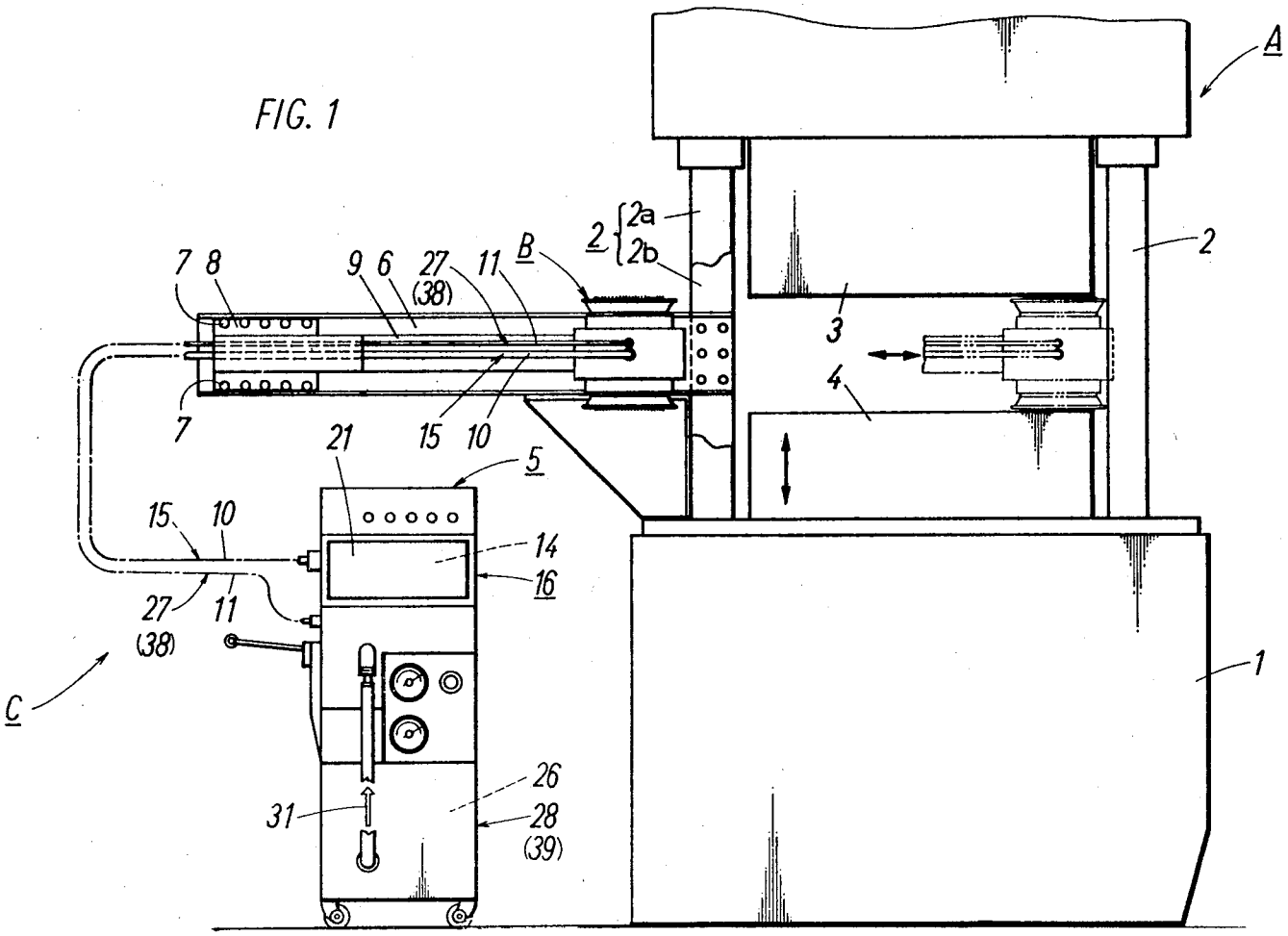
FIG. 1 is a front view, partly broken away, showing a cleaning apparatus of the invention mounted on a plastics molding machine.

The invention will now be described in more detail with reference to the drawings showing embodiments thereof. A semiconductor element-sealing plastics molding machine or other plastics molding machine A, as shown in FIG. 1, comprises a fixed mold 3 fixed in position in the upper region of the molding machine body 1 by a plurality of pillars 2, and a movable mold 4 disposed below said fixed mold in opposed relation thereto.

A cleaning apparatus B of the present invention is so designated that it can be advanced to be positioned between the molds 3 and 4 as shown in phantom lines when the molds 3 and 4 are opened, and that it can be retracted laterally of the molding machine body 1 when the molds are closed so as not to interfere with the mold closing operation. The aforesaid advance and retraction of the cleaning apparatus are effected by the operating section 5 of an actuator C. The actuator comprises two guide rails 6 horizontally fixed to two pillars 2*a* and 2*b* on both sides of the molding machine body 1, a slide member 8 disposed between said rails through the intermediary of rotary rollers 7, and a support arm 9 for the cleaning apparatus B projecting toward and between the molds 3 and 4. Connected between said operating section 5 and the cleaning apparatus B are hoses 10 and 11 respectively forming a portion of air suction and air feed paths to be described later.

The cleaning apparatus B comprises vibratory brushes 12 adapted to be vertically vibrated with respect to the faces 3*a* and 4*a* of the molds 3 and 4, respectively, annular rotary brushes 13 each surrounding the associated vibratory brush, and a dirt sucking mechanism 16 having an air suction path 15 establishing fluid communication between the spaces between said vibratory and rotary brushes 12 and 13 and a vacuum source 14, such as a vacuum pump, in the operating section 5 of the actuator C.

Each rotary brush 13 can be rotated in a horizontal direction by a rotary mechanism 17 which comprises a brush member setting rotary sleeve 17*a* which has a brush member 13*a* set therein and which is horizontally rotatably fitted at the front end of the support arm 9, a rotary gear 17*b* formed around the outer periphery of said rotary sleeve, and a drive gear 17*c* meshing with said rotary gear and driven by a reversible motor 18.

Each vibratory brush 12 is designed so that it can be vertically vibrated by a vertically vibrating mechansim 19 which comprises a brush member setting base 19*a* which has brush members 19*a* set therein and which is nonrotatably but vertically movably fitted at the front end of the support arm 9 by means of a rotation-preventative key 19*a*, a coil spring 19*c* resiliently pulling said base inwardly to urge it away from the associated mold face 3*a* or 4*a*, a plurality of radially extending recesses 19*d* disposed circumferentially at regular intervals on the inner peripheral region of the circular block portion of said base, and engaging rollers 19*e* journaled in the rotary sleeve 17*a* of said rotary mechanism 17 at positions corresponding to the positions of said recesses.

Further, the spaces 20 defined between the vibratory and rotary brushes 12 and 13 communicate with the vacuum source 14 through the air suction path 15 which comprises an air passage 9*a* formed in the support arm 9, and the air hose 10 interconnecting said passage and a dirt collecting case 21 disposed at the aforesaid operating section 5. Thus, the air 22 in the spaces 22 is sucked into the dirt collecting case 21 through said path 15, so that flash peeled from the mold faces 3*a* and 4*a* is sucked into the dirt sucking mechanism 16. A seal member 23 is interposed between the outer periphery of each rotary sleeve 17*a* and a case body 24.

The cleaning action of the present apparatus arranged in the manner described above will now be described.

First, the operating section 5 of the actuator C is operated to advance the cleaning apparatus B until it is positioned between the mold halves 3 and 4 which are opened now, and the motor 18 and the dirt sucking mechanism 16 of the cleaning apparatus B are actuated at the same time, whereupon the rotary drive force of the motor 18 rotates the rotary brushes 13 through the drive gears 17*c*, rotary gears 17*b* and rotary sleeves 17*a* of the rotary mechanisms 17, so that the front end portions of the brush members 13*a* move horizontally while sliding on flash surfaces adhering to the mold faces 3*a* and 4*a*.

Figure 4:
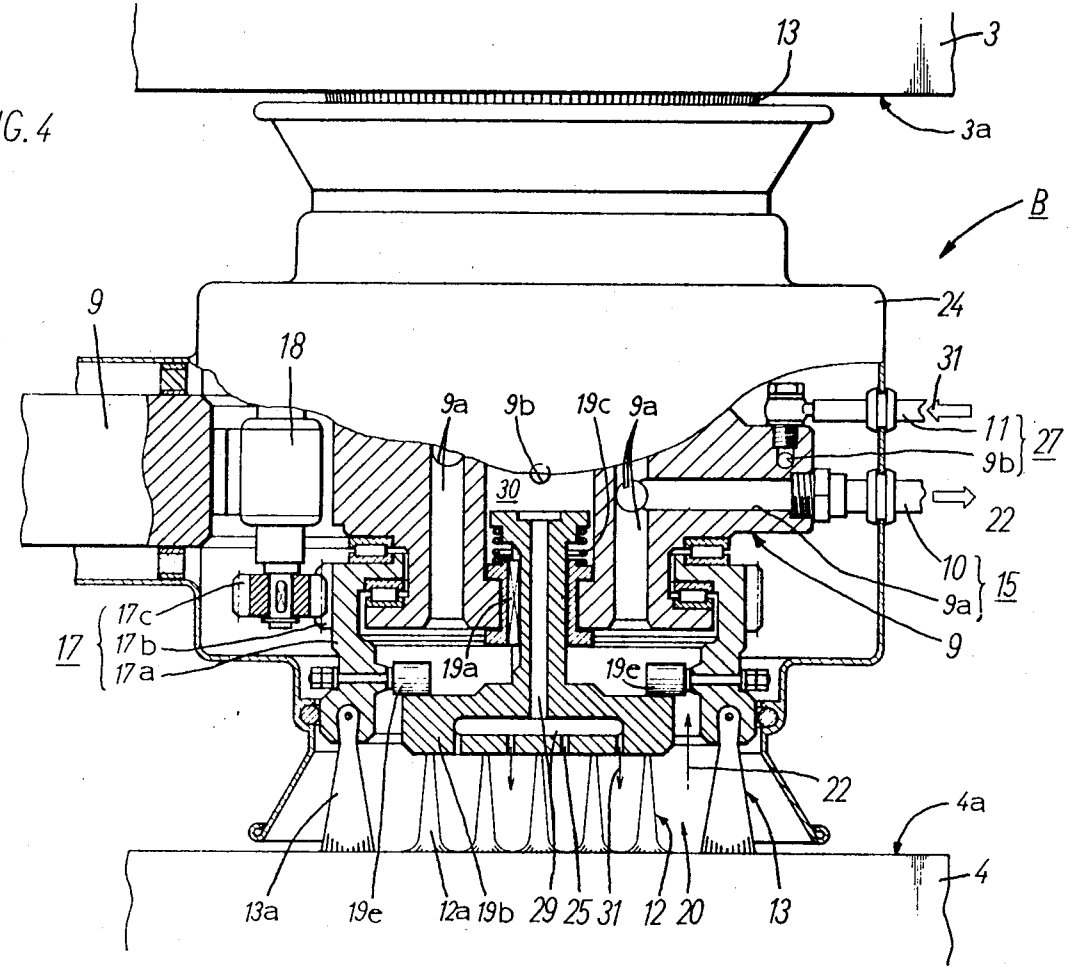
FIG. 4 is a side view, partially in section, showing the operation of a vibratory brush vibrating vertically.

On the other hand, the vibratory brushes 12 vertically move as shown in FIGS. 4 and 5 by the rotation of the engaging rollers 19*e* journaled in the rotary sleeves 17*a* of the rotary mechanisms 17 under the resilient pulling actions of the coil springs 19*c*. More particularly, when the engaging rollers 19*e* engage the recesses 19*d* formed in the setting bases 19*b* for the brush members 12*a*, the brush members 12*a* are moved away from the mold faces 3*a* and 4*a* under the resilient pulling actions of the coil springs 19*b* through the bases 19*b*, as shown in FIG. 5A, but when the engaging rollers are disengaged from the recesses 19, the engaging rollers 19*e* push the bases 19*b* toward the mold faces 3*a* and 4*a* by a distance corresponding to the depth of the recesses 19*d*, as shown in FIG. 5B, thus vertically vibrating the vibratory brushes 12, so that the rotation of the rotary brushes 13 and the upward and downward movement of the vibratory brushes 12 are simultaneously effected.

The upward and downward movement of the vibratory brushes 12 brings about a remarkable flash peeling effect. As shown in FIG. 5B, the front end portions of the brush members 12*a* break the flash by imparting percussive forces in a substantially vertical direction to the flash D adhering to the mold faces 3*a* and 4*a* and then said front end portions are bent while penetrating through the cleavages toward the mold faces 3*a* and 4*a*, so that the percussive and bending actions of the brush members 12*a*, coupled with the rubbing action of the rotary brushes 13, reliably peel the flash D from the mold faces.

Further, since air suction forces are acting in the spaces 20 defined between the brushes 12 and 13, the flash peeled by the brush members 12*a* and 13*a* is sucked away into the dirt collecting case 21 along with the air 22 in said spaces via the air suction path 15.

The present cleaning apparatus has an air blowing mechanism 28 added to the aforesaid arrangement, whereby the flash peeling effect can be further improved.

The air blowing mechanism 28 comprises numbers of air spout holes 25 formed in the circular blocks of the setting bases 19*b* for the brush members 12*a*, an air feed source 26, such as a compressor, installed in the aforesaid operating section 5, and an air feed path 27 establishing fluid communication between said air spout holes and said air feed source. The air feed path 27 comprises air passages 29 formed in the setting bases 19*b* and communicating with the air spout holes 25, air passages 9*b* and 30 in the support arm 9 communicating with said air passages 29, and the air hose 11 connecting said passages 9*b* and 30 to the air feed source 26.

According to the present cleaning apparatus having said air blowing mechanism 28 added thereto, an air blowing action on the mold faces 3*a* and 4*a* is added to the action of said apparatus. Thus, when said air blowing mechanism 28 is actuated, compressed air 31 is blown against the mold faces 3*a* and 4*a* via the air feed path 27. This air blowing action serves to cool the flash D to a temperature lower than that of the mold halves 3 and 4, rending the flash D easily peelable from the mold faces, so that coupled with the actions of the vibratory and rotary brushes 12 and 13, said air blowing action enhances the flash peeling effect.

FIG. 6 shows another embodiment of the invention, and in this cleaning apparatus, the vibratory brushes 12 and the vertically vibrating mechanism 19 in the preceding embodiment are replaced by vibratory brushes 32 which vibrate in unspecified directions, and vibrating mechanisms 33 therefor.

Each vibrating mechanism 33 is of known construction wherein a plurality of swingable shafts 34 are installed on the front end of the support arm 9 with vibration insulation members 35, such as of rubber, attached thereto, said vibrating mechanism holding a setting base 36 for the vibratory brush members 32*a* of the vibratory brush 32, the arrangement being such that when the vibrating mechanisms are actuated, the front end portions of the brush members 32*a* impart vibrations in unspecified directions to the flash adhering to the mold faces 3*a* and 4*a*.

Thus, according to this embodiment, the brush members 32*a* of the vibratory brushes are vibrated in unspecified directions for a complex combination of vertical, horizontal, oblique, etc. directions, in contrast to the simple vibrating action in the vertical or specified direction of the vibratory brushes 12 in the preceding embodiment. Therefore, the effect of peeling flash adhering to the mold faces 3*a* and 4*a* can be further improved.

The cleaning apparatus in this embodiment also has an air blowing mechanism 39 (FIG. 1) attached thereto for blowing air against the mold faces 3*a* and 4*a*. As shown in FIG. 6, said air blowing mechanism 39 comprises numbers of air spout holes 37 formed in the circular blocks of the setting bases 36 for the brush members 32*a*, the air feed source 26 at the aforesaid operating section 5, and an air feed path 38 establishing fluid communication between said air spout holes and said air feed source.

The air feed path 38 comprises air feed passages 40 in the setting bases 36 communicating with the air spout holes 37, air hoses 41 connecting said air passages to the air passage 9*b* in the support arm 9, and an air hose 42 connecting the air passages 9*b* to the air feed source 26. Thus, when the air blowing mechanism is actuated, compressed air 43 is blown against the mold faces 3*a* and 4*a* via the air feed path 38 and cools the flash adhering to the mold faces to render it easily peelable from the mold faces. Thus, coupled with the aforesaid peeling action of the rotary and vibratory brushes 13 and 32, this cooling action improves the flash peeling effect.

In addition, the embodiments described above have illustrated an instance in which the present cleaning apparatus is used as a cleaning apparatus for the faces of two mold halves disposed one above the other; however, the present cleaning apparatus is, of course, usable as a cleaning apparatus for the faces of two mold halves which are disposed horizontally.

While preferred embodiments of the invention have been described in detail, they are for illustrative purposes only, and it is to be understood that all changes and modifications thereof that do not depart from the spirit and scope of the invention are to be covered in the appended claims.

What is claimed is:

1. An apparatus for cleaning opposed mold faces of a pair of mold halves of a plastic forming mold, comprising first and second sets of oppositely directed vibratory brushes adapted to be disposed in opposed relation to the said faces of the pair of mold halves, vibrating means for vibrating said vibratory brushes, first and second sets of oppositely directed rotary brushes adapted to be disposed in opposed relation to the said mold faces and located in surrounding relationship to respective ones of said sets of said vibratory brushes, rotating means for rotating said rotary brushes and a flash sucking means for sucking away flash peeled from the mold faces by said vibratory and rotary brushes.

2. An apparatus as set forth in claim 1, wherein said vibrating means provides axial vibration of said vibratory brushes.

3. An apparatus as set forth in claim 1, wherein said vibrating means provides vibration of said vibratory brushes in random directions.

4. An apparatus as set forth in claim 1, wherein spaces are defined between said vibratory and rotary brushes and wherein the flash sucking means establishes fluid communication between said spaces and a vacuum source through an air suction path.

5. An apparatus as set forth in claim 1, including an air blowing means for blowing air against the said mold faces to cool the flash.

6. An apparatus as set forth in claim 1 wherein said means for vibrating said vibratory brushes includes means responsive to said rotating means for rotating said rotary brushes.

7. An apparatus as set forth in claim 6 wherein said means responsive to said rotating means includes a plurality of roller members, said vibrating means further comprising a base member including a plurality of recesses around the periphery thereof for receiving said roller members during a portion of the rotation of said rotating means.

* * * * *